5/1/84 XR 4,446,035

United States Patent [19]

Barrat et al.

[11] 4,446,035

[45] May 1, 1984

[54] CLEANSING AGENTS AND THE LIKE WITH AMINO-SILANES

[75] Inventors: Christian R. Barrat; John R. Walker, both of Brussels; Jean Wevers, Strombeek-Bever, all of Belgium

[73] Assignee: The Procter & Gamble Company, Cincinnati, Ohio

[21] Appl. No.: 421,183

[22] Filed: Sep. 22, 1982

[30] Foreign Application Priority Data

Sep. 25, 1981 [GB] United Kingdom ..... 8129071

[51] Int. Cl.[3] ..... C11D 3/08; C11D 9/36

[52] U.S. Cl. ..... 252/8.8; 252/98; 252/99; 252/102; 252/110; 252/117; 252/135; 252/156; 252/174.13; 252/174.15; 252/174.16; 252/174.21; 252/174.23; 252/527; 252/528; 252/529; 252/546; 252/547; 252/548; 252/535; 252/536; 252/539; 252/554; 252/555; 252/558; 252/174.25

[58] Field of Search ..... 252/8.8, 98, 99, 102, 252/174.15, 174.16, 174.23, 110, 117, 547, 156, 548, 539, 559, 546, 554, 535, 555, 536, 135

[56] References Cited

U.S. PATENT DOCUMENTS

| | | | |
|---|---|---|---|
| 2,971,864 | 2/1961 | Speier | 427/388 |
| 2,972,598 | 2/1961 | Morehouse | 260/46.5 |
| 3,033,815 | 5/1962 | Pike et al. | 260/46.5 |
| 3,085,908 | 4/1963 | Morehouse et al. | 427/388 R X |
| 3,175,921 | 3/1965 | Hedlund | 427/409 |
| 3,876,459 | 4/1975 | Burrill | 427/387 |
| 4,005,025 | 1/1977 | Kinstedt | 252/547 X |
| 4,005,030 | 1/1977 | Heckert et al. | 252/140 |
| 4,005,118 | 1/1977 | Heckert et al. | 252/546 |
| 4,013,573 | 3/1977 | Leikhim et al. | 252/99 X |
| 4,013,574 | 3/1977 | Leikhim et al. | 252/99 X |
| 4,062,999 | 12/1977 | Kondo et al. | 428/391 |
| 4,137,179 | 1/1979 | Koerner et al. | 252/8.6 |
| 4,152,273 | 5/1979 | Weiland | 252/8.8 |

FOREIGN PATENT DOCUMENTS

| | | |
|---|---|---|
| 753603 | 2/1967 | Canada . |
| 1793280 | 2/1972 | Fed. Rep. of Germany . |
| 2843709 | 4/1979 | Fed. Rep. of Germany . |
| 1207724 | 2/1960 | France . |
| 2299447 | of 0000 | France . |
| 53-87316 | 8/1978 | Japan . |
| 858445 | 1/1961 | United Kingdom . |

OTHER PUBLICATIONS

U.S. Ser. No. 421,185, Barrat et al., Filed 9/22/82.
U.S. Ser. No. 421,186, Barrat et al., Filed 9/22/82.
U.S. Ser. No. 421,187, Barrat et al., Filed 9/22/82.
U.S. Ser. No. 421,182, Barrat et al., Filed 9/22/82.
U.S. Ser. No. 421,183, Barrat et al., Filed 9/22/82.

*Primary Examiner*—P. E. Willis, Jr.
*Attorney, Agent, or Firm*—Donald E. Hasse; Robert B. Aylor; Thomas H. O'Flaherty

[57] ABSTRACT

Compositions of matter useful in the manufacture of superior cleaning and fabric treating compositions, bleaches, and the like, comprise amino-silane compounds in combination with ingredients such as cationic fabric softeners, or detersive surfactants, or bleach or the like.

Such compositions are especially useful in aqueous fabric laundering baths and in combined fabric drying-/softening operations since the amino-silane provides a protective effect to the surface of the washing machine or dryer. The compositions are also useful in the formulation of porcelain-safe toilet cleaners, machine- and hand-dishwashing compositions that protect fine chinaware, and for similar uses wherein silicate or metal surfaces come in contact with harsh chemicals, especially in the presence of hot water.

13 Claims, No Drawings

CLEANSING AGENTS AND THE LIKE WITH AMINO-SILANES

BACKGROUND OF THE INVENTION

This invention relates to the discovery that amino-silanes can protect surfaces, such as those of washing machine drums and dryer drums, from the erosive effects of detersive surfactants, fabric softeners, metal chelating agents, bleaches, caustics and the like, commonly found in commercial fabric care and general-purpose cleaning products. The invention also provides compositions and means for protecting the surface of porcelain, chinaware and glassware from erosive effects caused by similar ingredients used in dishwashing products, especially automatic dishwashing products, toilet bowl cleansers, porcelain cleansers, window cleaners, abrasive cleansers, car-wash-cleansers, industrial cleansers, and the like.

As is well-known in the art, prolonged or repeated contact of washing machine drums, dryer drums, and the like, with common ingredients found in detergent composition can cause the drum surface to erode. In particular the vitreous (silicate-based) enamels used to coat such drums can be gradually chemically decomposed by such ingredients. The soluble silicates used in most granular detergents somehow protect the enamel, but such silicates are not particularly useful in the liquid detergents now being marketed.

Likewise, the drums in automatic clothes dryers can be eroded by the action of cationic fabric softeners. Various methods to prevent this have been suggested in the art. However, such methods generally employ fatty or greasy materials which can stain fabrics.

Products formulated to cleanse porcelain surfaces (e.g. toilets, wash basins, bath tubs, etc.) often contain caustics or bleaches, chelating agents, etc. Such ingredients, while effectively boosting cleansing power, can damage porcelain. Moreover, toilet bowl cleansers designed for use in the flush tank can erode the brass or copper fittings of the flushing assembly.

As is well-known, some automatic dishwashing products should not be used on fine china or glassware because of the possibility of damage to the delicate silicate surfaces or glaze thereon.

A wide variety of methods for protecting surfaces have been disclosed in the literature. As mentioned above, water-soluble silicates provide some protection. Sorbitan esters are used in dryer-added fabric softeners. Phosphonated octadecane has been taught for use in detergents, as has oleic acid. Yet, none of these materials has proven as effective and efficient for protecting surfaces, especially vitreous silicate (i.e., "enamel", porcelain, chinaware, etc.) surfaces as the amino-silane materials employed in the present invention.

It is an object of the present invention to provide compositions useful in cleaning, bleaching, textile treating, and the like products, that are safe for the surfaces of washing machines, laundry dryers, porcelain and chinaware items, glassware, and the like, which typically come in contact with such products.

It is another object herein to provide a means for protecting silicate surfaces, such as those mentioned above, from erosive effects of harsh chemicals, said method comprising contacting said surfaces with an amino-silane of the type disclosed herein.

These objects are secured by the practice of the technology described more fully, hereinafter.

SUMMARY OF THE INVENTION

This invention provides compositions of matter which comprise:

(A) an amino-silane ingredient of the formula:

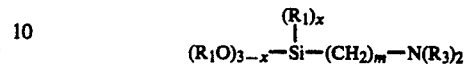

wherein:

$R_1 = C_{1-4}$-alkyl or $C_{1-4}$-hydroxyalkyl;

x is 0 or 1;

m is 1–6;

$R_3$ is hydrogen, $R_1$, $C_{1-6}$-alkylamine,

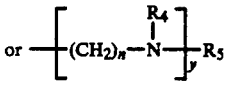

$R_4$ is hydrogen or $R_1$;

n is 1–6;

y is 0–6;

$R_5 = R_4$,

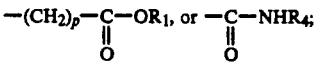

p = 1–6.

The $R_3$'s can be identical or different.

(B) an ingredient selected from the group consisting of:

(i) organic detersive surfactants;

(ii) fabric softeners;

(iii) bleaches;

(iv) caustics;

(v) metal sequestering and detergent builder agents; or (vi) mixtures of the foregoing ingredients (i)–(v).

This invention also provides a means for protecting the surface of metal and, more particularly, protecting silicate surfaces (especially vitreous silicates such as porcelain, chinaware, enamel) by contacting such surfaces with compositions comprising said ingredients A and B, disclosed hereinabove.

DETAILED DESCRIPTION OF THE INVENTION

The amino-silanes employed in the practice of this invention are exhaustively described in U.S. Pat. Nos. 2,971,864; 3,175,921 and U.K. No. 858,445. Means for preparing amino-silanes are disclosed in U.S. Pat. Nos. 2,972,598 and 3,033,815. It is to be understood that the present invention does not encompass the amino-silanes per se, nor their method of preparation. These are well-known in the art.

Indeed, amino-silanes useful in the practice of this invention are available under product numbers Z-6020 from DOW CORNING CORPORATION and A-1100, A-1120 and A-1130 from UNION CARBIDE CORPORATION.

It is noteworthy that U.S. Pat. No. 3,175,921 discloses the use of amino-silanes for improving the corrosion resistance of metal surfaces, but does not appear to contemplate the use of such compounds to protect silicate surfaces. U.S. Pat. No. 2,971,864 teaches the surface treatment of glass with amino-silanes so that the glass can be dyed. However, a protective effect for the glass surface does not appear to have been recognized by the patentees.

Moreover, while U.S. Pat. No. 3,175,921 briefly discloses metal cleaning and polishing compositions which can contain "emulsifying agents", the preparation of compositions of the type disclosed herein does not appear to have been contemplated.

Quaternized amino-silanes are known from U.S. Pat. Nos. 4,005,118 and 4,005,025, to be suitable for conferring soil release properties to metallic and vitreous surfaces upon application from a wash or rinse-solution. Unfortunately, such quaternized amino-silanes are subject to deactivation during storage, especially in water.

The compositions herein comprise, as the first ingredient (A), an amino-silane of the general formula disclosed hereinabove. Preferred amino-silanes for use herein can carry the following substituents:

$R_1$=—$CH_3$ or —$C_2H_5$ x=0 m=2 or 3

$R_3$=hydrogen and

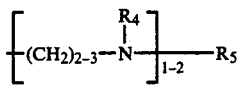

$R_4$=hydrogen or methyl $R_5$=hydrogen or methyl.

The most preferred amino-silanes have the following chemical formula:

$$(CH_3—O)_3—Si—(CH_2)_3—NH—(CH_2)_2—NH_2 \quad (a)$$

$$(CH_3—O)_3—Si—(CH_2)_3—NH—(CH_2)_2—N(CH_3)_2 \quad (b)$$

$$(CH_3—O)_3—Si—(CH_2)_3—NH—(CH_2)_3—NH_2 \quad (c)$$

$$(CH_3—O)_3—Si—(CH_2)_3—NH—(CH_2)_3—N(CH_3)_2 \quad (d)$$

$$(CH_3—O)_3—Si—(CH_2)_3—NH—(CH_2)_2—NH(CH_2)_2NH_2 \quad (e)$$

$$(C_2H_5O)_3—Si—(CH_2)_3NH_2.$$

The above structural formulae correspond to the following chemical names:

N-(trimethoxysilylpropyl)-ethylene diamine (a)

N-(trimethoxysilylpropyl)-N',N'-dimethylethylene diamine (b)

N-(trimethoxysilylpropyl)-propylene diamine (c)

N-(trimethoxysilylpropyl)-N',N'-dimethylpropylene diamine (d)

N-(trimethoxysilylpropyl)-diethylene triamine (e)

γ-aminopropyltriethoxysilane. (f)

The compositions herein also comprise one or more of the following ingredients (B). It will be readily appreciated by those skilled in the art of manufacturing cleansers, fabric softeners, and the like, that said ingredients (B) are well-known and widely available on a commercial scale. Accordingly the following listing of ingredients B(i)–B(v) is representative of typical materials useful in the practice of this invention, but is not intended to be an exhaustive or limiting compilation of operable ingredients. Moreover, it will also be appreciated that said ingredients (B) can be used in combination with each other, depending on the objectives of the formulator.

Ingredient B(i)

Water-soluble detersive surfactants useful herein include common soap, alkyl benzene sulfates and sulfonates, paraffin sulfonates, olefin sulfonates, alkoxylated (especially ethoxylated) alcohols and alkyl phenols, amine oxides, and the like, which are all well-known from the detergency art. In general, such detersive surfactants contain an alkyl group in the $C_{10}$–$C_{18}$ range; the anionic detersive surfactants most commonly used in the form of their sodium, potassium or triethanolammonium salts; the nonionics generally contain from about 3 to about 17 ethylene oxide groups. U.S. Pat. Nos. 4,111,855 and 3,995,669, incorporated herein by reference, contain detailed listings of such typical detersive surfactants. Mixtures, especially mixtures of $C_{12}$–$C_{16}$ alkyl benzene sulfonates with $C_{12}$–$C_{18}$ alcohol- or alkylphenol-ethoxylates (EO 3–15) provided exceptionally good fabric cleaning compositions.

Ingredient B(ii)

Fabric softeners useful herein include the well-known cationic softeners such as the substantially water-insoluble di-alkyl quaternary ammonium compounds and alkyl and di-alkyl imidazoliniums. The alkyl group is generally in the $C_{12}$–$C_{18}$ range, especially stearyl. Again, a great many such materials are well-known and fully-described in the patent literature. See, for example, U.S. Pat. No. 4,128,484 and European patent application No. 78-200059.0. Mixtures of such softeners can also be employed herein.

Ingredient B(iii)

Fabric and hard-surface bleaches which remove stains are also very well-known in the cleansing art. Hypochlorite bleach is widely used, as is sodium perborate, both with and without activators like tetraacetylethylenediamine, and sodium percarbonate. Other well-known bleaches include the peroxy-acids like diperazelaic acid, peracetic acid, and the like. Perborate bleach is widely used in fabric detergent compositions. Hypochlorite bleaches find wide-spread use in a variety of cleaning and disinfecting compositions. Cyanurate bleaches are used in some automatic dishwashing compositions.

Ingredient B(iv)

Caustics typically found in cleaning compositions for home use include the alkali metal hydroxides and alkanolamines such as triethanolamine. Higher concentrations of NaOH are used in some industrial-strength cleaners. Sodium bicarbonate is also commonly found in such compositions. Water-soluble sodium silicate is commonly used in detergent compositions, but powdered sodium silicate presents a special problem in the present invention since the amino-silanes appear to adsorb tightly to its surface and, hence, are rendered ineffective for their intended purpose. To circumvent this problem, the amino-silane, or the silicate, or both, can be coated or otherwise encapsulated to prevent contact in the product on storage.

Ingredient B(v)

Compounds classifiable and well-known in the art as detergent builders include the nitrilotriacetates, polycarboxylates, citrates, water-soluble phosphates, mixtures of ortho- and pyro-phosphates, zeolites especially hydrated Zeolite A in the 1-10 micron particle size range, and mixtures thereof. Metal ion sequestrants include all of the above, plus materials like ethylenediaminetetraacetate, the amino-polyphosphonates (DEQUEST) and a wide variety of of other poly-functional organic acids and salts too numerous to mention in detail here. See U.S. Pat. No. 3,579,454, incorporated herein by reference, for typical examples of the use of such materials in various cleaning compositions.

As can be seen from the foregoing, a wide variety of well-known, standard, ingredients can be used as Ingredient (B) in the present compositions. Further reference can be made to the cited patents for details on various combinations of such ingredients designed for specialized uses.

A particularly preferred composition according to the invention comprises:

(1) from about 5% to about 75%, preferably from about 10% to about 50%, of organic detersive surfactant [(B) (i)];

(2) from about 5% to about 80%, preferably from about 10% to about 50% of metal sequestering and detergent builder agents [(B) (v)], preferably sodium or potassium pyrophosphate, orthophosphate, tripolyphosphate, nitrilotriacetate, zeolite A, polyacetal, carbonate or mixtures thereof, most preferably sodium pyrophosphate;

(3) from 0% to about 10% of a film forming polymer, described hereinafter, preferably from about 0.1% to about 10%, more preferably from about ½% to about 5%, most preferably from about 1% to about 2%;

(4) from 0% to about 6%, more preferably less than about 4%, most preferably from about 1% to about 2% of a water soluble silicate, preferably sodium or potassium silicate, preferably sodium, having an $SiO_2$:$Ma_2O$ ratio of from about one to about 3, most preferably from about 1.4 to about 2.4, where M is an alkali metal or the equivalent; and (5) from about 0.01% to about 1%, preferably from about 0.02% to about ½% of amino-silane ingredient (A);

The composition being preferably in granular form and more preferably being at least partially spray-dried and preferably being essentially free of silica, especially hydrophobic silica.

Film-Forming Polymer

These preferred compositions of the present invention contain from about 0 to about 10%, preferably from about ½% to about 5% and more preferably from about ½% to about 2%, by weight of a film-forming polymer, preferably soluble in an aqueous slurry comprising the organic surfactants and neutral or alkaline salts herein. It will be appreciated, for spray dried granules, that the polymer must be at least partially soluble in the slurry for it to dry to a film capable of cementing the granule walls together as the slurry is dried. For optimum spray-dried granule physical properties, the polymer should be substantially soluble in the slurry, and is preferably completely soluble in the slurry. The slurry will usually be alkaline in nature due to the presence of alkaline salts. Since the slurry will generally be a strong electrolyte solution, optimum solubility of the polymer is obtained when it is in the form of an at least partially neutralized or substituted alkali metal, ammonium or substituted ammonium (e.g., mono- di- or triethanol ammonium) salt. The alkali metal, especially sodium, salts are most preferred. While the molecular weight of the polymer can vary over a wide range, it preferably is from about 1000 to about 500,000, more preferably is from about 2000 to about 250,000, and most preferably is from about 3000 to about 100,000.

Suitable film-forming polymers herein include homopolymers and copolymers of unsaturated aliphatic mono- or polycarboxylic acids. Preferred carboxylic acids are acrylic acid, hydroxyacrylic acid, methacrylic acid, maleic acid, fumaric acid, itaconic acid, aconitic acid, crotonic acid, and citraconic acid. The polycarboxylic acids (e.g., maleic acid) can be polymerized in the form of their anhydrides and subsequently hydrolyzed. The copolymers can be formed of mixtures of the unsaturated carboxylic acids with or without other copolymerizable monomers, or they can be formed from single unsaturated carboxylic acids with other copolymerizable monomers. In either case, the percentage by weight of the polymer units derived from non-carboxylic acids is preferably less than about 50%. Suitable copolymerizable monomers include, for example, vinyl chloride, vinyl alcohol, furan, acrylonitrile, vinyl acetate, methyl acrylate, methyl methacrylate, styrene, vinyl methyl ether, vinyl ethyl ether, vinyl propyl ether, acrylamide, ethylene, propylene and 3-butenoic acid.

Preferred polymers of the above group are the homopolymers and copolymers of acrylic acid, hydroxyacrylic acid, or methacrylic acid, which in the case of the copolymers contain at least about 50%, and preferably at least about 80% by weight of units derived from the acid. Particularly preferred polymers are sodium polyacrylate and sodium polyhydroxyacrylate, especially the polyacrylates having molecular weights of from about 10,000 to about 200,000. Other specific preferred polymers are the homopolymers and copolymers of maleic anhydride, especially the copolymers with ethylene, styrene and vinyl methyl ether. These polymers are commercially available under the trade names Versicol and Gantrez.

Other film-forming polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable film-forming polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,919,107, Thompson, issued Nov. 11, 1975; the hydroxyalkyl starch ethers, starch esters, oxidized starches, dextrins and starch hydrolysates described in U.S. Pat. No. 3,803,285, Jensen, issued Apr. 9, 1974; and the carboxylated starches described in U.S. Pat. No. 3,629,121, Eldib, issued Dec. 21, 1971; all incorporated herein by reference. Preferred polymers of the above group are the carboxymethyl celluloses.

Moreover, the compositions herein can contain, in addition to ingredients (A) and (B) various optional ingredients typically used in commercial products to provide aesthetic or additional product performance benefits. The amino-silanes used herein do not interfere with the benefits provided by such ingredients. Typical ingredients include suds regulants, perfumes, dyes, optical brighteners, soil suspending agents, detersive enzymes, thickeners, gel-control agents, freeze-thaw stabilizers, bactericides, preservatives, and the like.

A special advantage of the amino-silanes herein is that they can be used in extremely low levels and still provide the desired benefits. Compositions of the present A+B type provide the desired benefits when the weight ratio of ingredient A to ingredient B is as little as 1:1.000.000. More preferred are compositions wherein the A:B ratio is at least about 1:5.000, most preferably at least about 1:1.000. Moreover, the compositions can be formulated over a wide pH range of 2–12; preferably the pH is in the alkaline range of about 7–11 for cleaning compositions.

The following examples are intended to illustrate compositions of the type encompassed by this invention, but are not intended to be limiting thereof. The compositions can be prepared, for example, using conventional spray-on, admix, spray-dry, and blending operations. The amino-silanes herein give no special handling problems other than with granular silicates, as noted above. Moreover, since it is preferred that the amino-silanes be substantially in the monomeric state, processing temperatures should preferably be below 80°–100° C. if water is present. Such matters are within the routine experience of formulators who are at all familiar with hydrolyzable organosilanes.

EXAMPLE I

Liquid detergent compositions were prepared by mixing the listed ingredients in the stated proportions.

| INGREDIENTS | COMPOSITIONS A | COMPOSITIONS I |
|---|---|---|
| Linear dodecylbenzene sulfonic acid | 14 | 14 |
| Condensation product of one mole of C13–C15 OXO alcohol and 7 moles of ethylene oxide | 15 | 15 |
| Lauric acid | 6 | 6 |
| Myristic acid | 4 | 4 |
| Oleic acid | 5 | 5 |
| Triethanolamine | 5 | 5 |
| Sodium hydroxide to adjust pH to | 7.7 | 7.7 |
| Ethanol | 10 | 10 |
| 1,2 propanediol | 4 | 4 |
| Proteolytic enzyme[a] | 0.05 | 0.05 |
| Calcium[b] | 2.0 | 2.0 |
| Sodium formate | 2.0 | 2.0 |
| Citric acid | 0.2 | 0.2 |
| Diethylenetriamine pentaphosphonic acid | 0.3 | 0.3 |
| Silane | — | 0.05 |
| Silicone suds regulant emulsion, brightener, perfume, opacifier, dye, antioxidant and water | BALANCE TO 100 | |

[a]MAXATASE ® supplied by GIST-BROCADES expressed on a 100% active basis.
[b]Added as calcium chloride and expressed as millimoles of calcium ion per kilo of composition.

The above compositions were used for comparative vitreous silicate enamel compatibility tests. The tests are carried out in a tergotometer whereby enamel-coated plate samples (10×5 cm) were fixed on the different agitators. The plates were immersed in the wash liquor (1.2% detergent concentration), kept under agitation at 85° C. The immersion test lasted 12 hours whereby the wash liquor was renewed every 3 hours. Enamel weight loss after testing was recorded and translated into a corrosion index as follows:

$$\frac{\text{enamel weight loss observed with composition } I}{\text{enamel weight loss observed with composition } A} \times 100.$$

Prior art composition A corresponds thus to a corrosion index of 100.

Amino-silanes in accordance with this invention and other silanes, incorporated in composition I, were compared for their effectiveness to protect enamel surfaces. The testing results were expressed with the aid of the enamel corrosion index (ECI).

| COMPOSITION | SILANE TYPE | ECI |
|---|---|---|
| A | no silane | 100 |
| I a. | $(C_2H_5O)_3Si(CH_2)_3NH_2$ | 25 |
| I b. | $(CH_3O)_3Si(CH_2)_3NH(CH_2)_2NH_2$ | 10 |
| I c. | $(CH_3O)_3Si(CH_2)_3NH(CH_2)_2NH_2$ | 15 |
| I d. | $(CH_3O)_3Si(CH_2)_2NH(CH_2)_2NH_2$ | 10 |
| I e. | $(CH_3O)_3Si(CH_2)_3NH(CH_2)_3NH_2$ | 13 |
| I f. | $(CH_3O)_2\overset{\overset{\displaystyle CH_3}{\vert}}{Si}(CH_2)_3NH(CH_2)_2NH_2$ | 14 |
| I g. | $(CH_3O)_3Si(CH_2)_3NH(CH_2)_6NH_2$ | 16 |
| I h. | $(CH_3O)_3Si(CH_2)_3NH(CH_2)_2N(CH_3)_2$ | 22 |
| I i. | $(CH_3O)_3Si(CH_2)_3\overset{\oplus}{N}(\underset{\underset{\displaystyle CH_3}{\vert}}{CH_3})(CH_2)_2OCO\underset{\underset{\displaystyle CH_3}{\vert}}{C}{=}CH_2$ | 75 |
| I j. | $(CH_3O)_3Si(CH_2)_3Cl$ | 100 |
| I k. | $(CH_3O)_3Si{-}CH{=}CH_2$ | 100 |
| I l. | $(CH_3O)_3Si(CH_2)_3SH$ | 75 |
| I m. | $(CH_3O)_3Si(CH_2)_3{-}O{-}CH_2{-}\underset{\underset{\displaystyle O}{\diagdown\ \diagup}}{CH{-}CH_2}$ | 100 |
| I n. | $(CH_3O)_2Si(CH_2)_3{-}OCO{-}\underset{\underset{\displaystyle CH_2}{\Vert}}{C}{-}CH_3$ | 100 |

These testing results confirm the consistent superiority of compositions in accordance with the invention (I a. to I h.) over composition A and as compared to structurally closely related silanes I i. to I n. different from the claimed species.

Composition I c., kept for 2 and 4 weeks at 35° C., was compared to an identical freshly made formulation I c. and to composition A. The % retained effectiveness was determined with the aid of the ECI, as described hereinbefore.

| | % retained effectiveness |
|---|---|
| Composition Ic.; freshly made | 100 |
| Composition Ic. after 2 weeks at 35° C. | 95 |
| Composition Ic. after 4 weeks at 35° C. | 80 |

This confirms the excellent and unexpected, compared to what was known from silane metal surface treatment from aqueous solutions, stability of amino-silane in liquid detergent matrixes.

The benefits of the invention were found to be provided at various pH as shown by comparative measurements with Composition I b. having a pH adjusted as indicated.

| | ECI |
|---|---|
| Composition A at pH 7.0/8.0/9.0 | 100 |
| Composition I b. at pH 7.0 as is | 20 |
| Composition I b. at pH 8.0 as is | 20 |
| Composition I b. at pH 9.0 as is | 15. |

EXAMPLE II

Liquid detergent compositions were prepared by mixing the listed ingredients in the stated proportions:

| INGREDIENTS | COMPOSITIONS B | II |
|---|---|---|
| Condensation product of one mole of C12-13 oxo alcohol and 6.5 moles of ethylene oxide | 6.4 | 6.4 |
| C12-14 alkyl dimethyl amine oxide | 3.3 | 3.3 |
| C12-14 alkyl triethoxyether sulfate sodium salt | 2.9 | 2.9 |
| Coconut fatty acid monoethanol amine | 2.1 | 2.1 |
| Sodium salt of nitrilotriacetic acid | 18.2 | 18.2 |
| Potassium toluene sulfonate | 9.0 | 9.0 |
| Sodium hydroxide to adjust pH to 11.3 | — | 0.05 |
| N—(trimethoxysilylpropyl)-ethylene diamine | | |
| Miscellaneous(perfume, brightener, dyes, sodium sulfite, oleic acid, water) | up to 100 | |

Comparative corrosion tests, similar to those described in Example I, were run under the following testing conditions: temperature 54° C.; 0.2% detergent concentration; 96 h. immersion. The comparative results expressed as ECI and loss of enamel gloss as measured with the aid of a Gardner gloss comparator, were as follows:

| COMPOSITIONS | ECI | % loss of enamel gloss |
|---|---|---|
| Composition B | 100 | 8 |
| Composition II | 20 | 1 |
| Silicated granular detergent | 40 | — |

These results confirm the high effectiveness of amino-silanes in liquid compositions. In addition, amino-silanes are at least as effective as silicate used in current granular detergents.

EXAMPLE III

A pasty cleanser suitable for cleaning ceramic tile and porcelain fixtures in the bathroom is prepared by blending the following ingredients:

$C_{12-13}$ alkyl benzene sulfonate (Na salt) 50 grams
N-(trimethoxysilylpropyl)-diethylene triamine 0.01 gram
1,3-propanediol 10 grams.

The product of Example III exhibits a low ECI, on the indicated silicate surfaces.

EXAMPLE IV

A fabric softener composition is prepared by gently warming and blending the following ingredients. The composition is dispersed in an aqueous laundry rinse bath in an enamel-coated washer drum at a concentration of about 0.01% by weight of the bath. Fabrics treated therewith are rendered soft, supple and static-free. The surface of the drum is protected from erosion by the amino-silane.

Distearyldimethylammonium methylsulfate 100 grams
N-(trimethoxysilylpropyl)ethylene diamine 0.8 grams
Perfume 0.05 grams.

A softener composition substantially equivalent to Example IV is prepared by replacing the quaternary ammonium compound with distearyl imidazolinium chloride. The product has a low ECI.

EXAMPLE V

A dryer-added fabric softening and anti-static article is prepared by impregnating a 20 cm×20 cm sheet of non-woven rayon with 3.5 grams of the composition of Example IV. In use, the article is added to a 3 kg load of mixed, damp fabrics in an automatic clothes dryer. The dryer is operated in standard fashion. The tumbling of the fabrics with the article provides the fabrics with a soft, anti-static finish. Staining and dryer drum erosion are minimized.

EXAMPLE VI

A detergency booster composition especially adapted for use with commercial laundering products in geographic areas having "hard" water is as follows:

Sodium tripolyphosphate 75 grams
Nitrilotriacetic acid (Na Salt) 25 grams
N-(trimethoxysilylpropyl)diethylene triamine 1.0 gram.

20 grams of the composition of Example VI is added to 10 liter aqueous wash liquor in an enamel washer drum, together with a standard, commercial laundry detergent. Fabric cleansing is improved, while the erosion of the washer drum enamel is minimized.

EXAMPLE VII

A hypochlorite bleach solution suitable for cleaning and sanitizing porcelain bathroom fixtures, as well as for bleaching fabrics is prepared by adding 2 grams of N-(trimethoxysilylpropyl)propylene diamine to 1 liter of commercial aqueous hydrochlorite (laundry "bleach"; as CLOROX). The resulting product exhibits a low ECI to silicate surfaces.

EXAMPLE VIII

Window cleaner compositions comprise from 0.001% to 5%, preferably 0.002% to 1%, of any of the amino-silanes (a)–(f) listed hereinabove. The remainder of the window cleaner composition comprises from 0.1% to 5%, preferably 0.5% to 3% of a water-soluble anionic detergent and the balance organic solvent or solvent-/water mixture. Suitable organic solvents include the following: methanol, ethanol, isopropanol, acetone, and methyl ethyl ketone.

EXAMPLE IX

A detergent composition intended for use in an automatic car wash comprises from 0.01% to 10%, preferably 0.1% to 2%, of any of the amino-silanes (a)–(f) listed hereinabove; from 20% to 35%, preferably 23% to 28% of an anionic detergent; and the balance water. Optionally from 1% to 10%, preferably 1% to 3% of magnesium sulfate, is included in the composition.

EXAMPLE X

In-tank toilet bowl cleaners comprise from 0.01% to 10%, preferably 0.5% to 2% of any of the amino-silanes (a)–(f) listed hereinabove; from 0.5% to 20%, preferably 1% to 15%, of an anionic or nonionic detergent; from 0.1% to 5%, preferably 0.5% to 2%, of sodium bisulfate; from 0.1% to 20%, preferably 1% to 15%, of a lower alcohol, i.e., a $C_{1-4}$ alcohol; and the balance water.

EXAMPLE XI

The amino-silanes herein can also be used in a detergent composition intended for the cleaning of hard surfaces such as ovens. Such compositions contain from 0.002% to 5%, preferably 0.01% to 1%, of the amino-silanes (a)–(f); from 0.1% to 10%, preferably 1% to 5%, of a water-soluble anionic detergent; and from 50% to 95%, preferably 50% to 75%, of a water-insoluble abrasive. Suitable abrasives include the following: pumice, talc, calcium carbonate, china clay, whiting, feldspar and aluminium oxide.

EXAMPLE XII

The following composition, intended for usage at a level of 1¼ cups (129 g) in a normal capacity, top-loading washing machine is prepared by spray-drying an aqueous crutcher-mix slurry of the components.

| Component | Wt. % |
|---|---|
| Sodium $C_{12}$ alkylbenzene sulfonate | 3.5 |
| Sodium tallow alkyl sulfate | 5.5 |
| Sodium $C_{14-15}$ alkyl polyethoxy (2.25) sulfate | 5.5 |
| Tetrasodium pyrophosphate | 24.0 |
| Sodium carbonate | 10.0 |
| Sodium silicate (2.Or) | 2.0 |
| Sodium sulfate | 42.0 |
| Polyethylene glycol 8000 | 1.0 |
| Sodium polyacrylate (avg. m.w. 50,000–70,000) | 1.0 |
| Water + minors | Balance to 100 |

To the above composition was added the indicated amounts of Silane Z-6020(*) and a detergent solution was prepared in Pyrex glassware to a concentration of about 1.2 grams per liter of water having a hardness of 10 grains and a temperature of about 54° C. Standard metal coupons covered with a porcelain finish representative of the drums of conventional washing machines were placed in the solution and the solution was agitated. The coupons were weighed at the indicated times to find the indicated weight losses. When the coupons were weighed, the old solutions were replaced with identical fresh solutions.

((*)N-trimethoxysilylpropyl)-ethylene diamine)

| | Weight Loss (milligrams) | | | | |
|---|---|---|---|---|---|
| | % Silane | | | | |
| Hours | 0 | 0.03 | 0.06 | 0.12 | 0.15 |
| 2 | −0.6 | −0.6 | −0.8 | −1.1 | −0.7 |
| 4 | −0.6 | −0.9 | −0.8 | −1.2 | −1.0 |
| 6 | −1.1 | −1.6 | −0.9 | −1.4 | −1.1 |
| 24 | −3.7* | −3.3 | −2.5 | −3.4 | −3.4 |
| 26 | −3.6 | −2.9 | −2.3 | −2.7 | −2.8 |
| 48 | −4.1 | −0.2 | −0.9 | −0.8 | −0.4 |

*The lower right edge of the left coupon had bare metal and corrosion visible.

As can be seen from the above, the silane protected the coupons upon prolonged exposure, apparently by deposition of the silane on the surface. The solution containing the product with 0% silane covered the Pyrex glassware surface with some kind of deposit.

Since the protection appears to depend upon deposition, it is preferred that the composition be essentially free of materials like silica and especially hydrophobic silica that will preferentially adsorb the silane.

Other compositions of the present invention are obtained when the pyrophosphate in the above composition is replaced with a mixture of 21% pyrophosphate and 5% of either hydrated sodium aluminosilicate Zeolite A (avg.dia.3 microns), sodium tripolyphosphate or sodium nitrilotriacetate, or when the silicate level is increased to 4%.

Other compositions herein are obtained when the polyacrylate is replaced with sodium polyhydroxyacrylate of m.w. 80,000, with a sodium polyacrylate polymer containing about 5–15% by weight of acrylamide and having a m.w. of about 20,000 or 40,000, or with sodium polyacrylate having a m.w. of 120,000.

All percentages, parts, and ratios used herein are by weight unless otherwise specified.

We claim:

1. A composition of matter, comprising:

(A) an amino-silane ingredient of the formula:

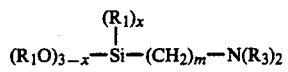

wherein:

$R_1 = C_{1-4}$-alkyl or $C_{1-4}$-hydroxyalkyl;

x is 0 or 1;

m is 1–6;

each $R_3$ is hydrogen, $R_1$, $C_{1-6}$-alkylamine,

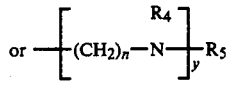

$R_4$ is hydrogen or $R_1$ n is 1–6 y is 0–6

$R_5 = R_4$,

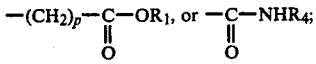

p = 1–6.

(B) an ingredient selected from the group consisting of:

(i) organic detersive surfactants;

(ii) fabric softeners;

(iii) bleaches;

(iv) caustics;

(v) metal sequestering and detergent builder agents; or (vi) mixtures of the foregoing ingredients (i)–(v).

2. A composition according to claim 1 wherein the weight ratio of ingredient A to ingredient B is at least about 1:1,000,000.

3. A composition according to claim 1 wherein the weight ratio of ingredient A to ingredient B is at least about 1:1,000.

4. A composition according to claim 1 wherein ingredient A is selected from the group consisting of N-(trimethoxysilylpropyl)-ethylene diamine N-(trimethoxysilylpropyl)-N',N'-dimethylethylene diamine N-(trimethoxysilylpropyl)-propylene diamine N-(trimethoxysilylpropyl)-N',N'-dimethylpropylene diamine N-(trimethoxysilylpropyl)-diethylene triamine and γ-aminopropyltriethoxysilane.

5. A composition according to claim 4 wherein ingredient B(i) is a detersive surfactant selected from the group consisting of water-soluble soap, alkyl benzene sulfonates, alkoxylated alcohols and alkoxylated alkyl phenols, olefin sulfonates, paraffin sulfonates, and mixtures thereof.

6. A composition according to claim 4 wherein ingredient B(ii) is a cationic fabric softener selected from the group consisting of quaternary ammonium and imidazolinium softeners, and mixtures thereof.

7. A composition according to claim 4 wherein ingredient B(iii) is a bleach selected from the group consisting of hypochlorites, peroxy-acids, cyanurates, percarbonates, perborates, or mixtures thereof.

8. A composition according to claim 4 wherein ingredient B(iv) is a caustic selected from the group consisting of alkali metal hydroxides, alkanolamines, and mixtures thereof.

9. A composition according to claim 4 wherein ingredient B(v) is a builder or metal sequestering agent selected from the group consisting of citric acid, the amino phosphonates, water-soluble phosphates, mixtures of ortho- and pyro-phosphate, nitrilotriacetates, polycarboxylates, the water-soluble salts and mixtures thereof, and hydrated zeolite A, and mixtures thereof.

10. A composition according to claim 1 containing from about 0.01% to about 1% of ingredient A; from about 5% to about 75% of ingredient B(i); from about 5% to about 80% of ingredient B(v); from about 0% to about 10% of a film-forming polymer; and from about 0% to about 6% of a water-soluble silicate having an $SiO_2$:$M_2O$ ratio of from about 1 to about 3.

11. The composition of claim 10 containing from about 0.02% to about ½% of ingredient A; from about 10% to about 50% of ingredient B(i), from about 10% to about 50% of ingredient B(v); from about ½% to about 5% of film-forming polymer; and from about 1% to about 2% of sodium or potassium silicate having an $SiO_2$:$M_2O$ ratio of from about 1.4 to about 2.4, said composition being in granular form.

12. A composition according to claim 11 wherein ingredient A is selected from the group consisting of:

N-(trimethoxysilylpropyl)-ethylene diamine

N-(trimethoxysilylpropyl)-N',N'-dimethylethylene diamine

N-(trimethoxysilylpropyl)-propylene diamine

N-(trimethoxysilylpropyl)-N',N'-dimethylpropylene diamine

N-(trimethoxysilylpropyl)-diethylene triamine and γ-aminopropyltriethoxysilane; and mixtures thereof; ingredient B(i) is selected from the group consisting of water-soluble soap, alkylbenzene sulfonates, alkoxylated alcohols, alkoxylated alkyl phenols, olefin sulfonates, paraffin sulfonates, and mixtures thereof; ingredient B(v) is selected from the group consisting of sodium or potassium pyrophosphate, orthophosphate, tripolyphosphate, nitrilotriacetate, zeolite A, polyacetyl carbonate or mixtures thereof; said film-forming polymer is a polyacrylate having a weight average molecular weight of from about 10,000 to about 200,000; and said silicate is sodium silicate, the composition being at least partially spray dried and being essentially free of hydrophobic silica.

13. A composition according to claim 1 in which ingredient B(v) is sodium or potassium pyrophosphate.

* * * * *